US005628256A

United States Patent [19]

Lazarus

[11] Patent Number: 5,628,256

[45] Date of Patent: May 13, 1997

[54] SHELVING ASSEMBLIES

[75] Inventor: Abraham Lazarus, Herzlia, Israel

[73] Assignee: Hoff Development Ltd., Herzlia Pituah, Israel

[21] Appl. No.: 339,788

[22] Filed: Nov. 15, 1994

Related U.S. Application Data

[63] Continuation-in-part of Ser. No. 212,198, Mar. 11, 1994.

[51] Int. Cl.[6] ..... A47B 9/00

[52] U.S. Cl. ..... 108/110; 108/180; 403/375; 211/188

[58] Field of Search ..... 108/180, 110, 108/186, 192, 153, 193; 403/375, 383, 403, 205, 387, 186, 305, 300, 361, 252, 258; 211/188, 186; 24/573.1

[56] References Cited

U.S. PATENT DOCUMENTS

| | | | |
|---|---|---|---|
| 1,172,026 | 2/1916 | Hough . | |
| 1,625,612 | 4/1927 | Jensen . | |
| 3,479,974 | 11/1969 | Ferdinand et al. | 108/144 |
| 3,480,155 | 11/1969 | Ferdinand | 311/190 |
| 3,636,893 | 1/1972 | Lange | 108/153 |
| 3,881,428 | 5/1975 | Klecki | 211/186 X |
| 3,883,104 | 5/1975 | Delafield | 248/188 |
| 3,912,410 | 10/1975 | Pofferi | 108/192 X |
| 3,932,047 | 1/1976 | Crossan | 403/186 |
| 3,981,250 | 9/1976 | Anthony | 108/106 |
| 4,135,837 | 1/1979 | Suttles | 403/245 |
| 4,509,806 | 4/1985 | Dudouyt | 312/257 |
| 4,515,280 | 5/1985 | Sheu | 211/189 |
| 4,585,365 | 4/1986 | Manno | 108/153 X |
| 4,607,576 | 8/1986 | Kranjec | 108/110 |
| 4,757,769 | 7/1988 | Suttles | 211/188 X |
| 4,763,796 | 8/1988 | Flum | 211/188 X |
| 5,348,170 | 9/1994 | Thornley et al. | 108/107 X |

FOREIGN PATENT DOCUMENTS

| | | | |
|---|---|---|---|
| 2342044 | 9/1977 | France | 108/180 |
| 2674581 | 10/1992 | France | 403/186 |
| 2038877 | 2/1972 | Germany | 108/186 |
| 3918180 | 3/1991 | Germany | 108/180 |
| 333858 | 12/1958 | Switzerland | 211/187 |
| 413267 | 12/1966 | Switzerland | 211/187 |
| 1448884 | 9/1976 | United Kingdom | 312/257.1 |
| 2260482 | 4/1993 | United Kingdom . | |

*Primary Examiner*—Peter M. Cuomo
*Assistant Examiner*—Janet M. Wilkens
*Attorney, Agent, or Firm*—Wigman, Cohen, Leitner & Myers, P.C.

[57] ABSTRACT

A shelving assembly for stands, wall-mounted shelves, and the like, includes a plurality of posts each having at least two longitudinally-extending sections joined together at an angle to each other along a juncture section. Each post is formed with at least one transverse slot extending through the juncture section and partly through the two longitudinally-extending sections, and is further formed on the inner face of the juncture section with a pair of coaxial eyelets on opposite sides of the slot. A panel is received within the slots of the posts, and a pin passes through each pair of eyelets and the panel for securing the panel to the posts.

20 Claims, 14 Drawing Sheets

128
127
129
120

120a
127a
120b
127b

135

135

120
127
130

120
127
130

FIG. 21
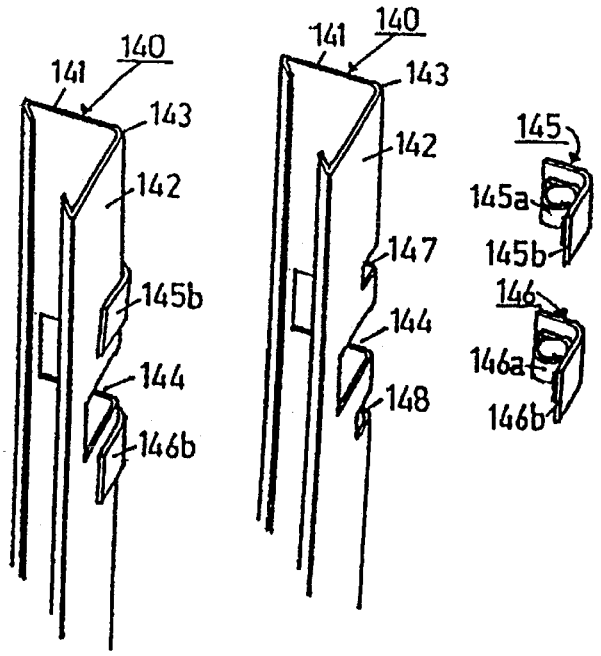
Fig. 21a
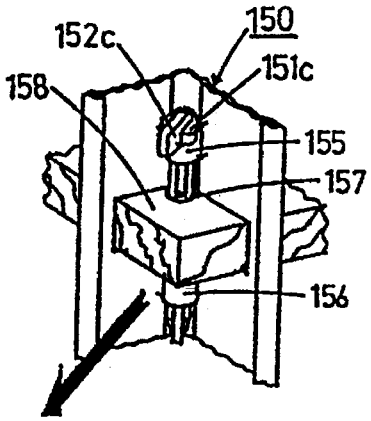
Fig. 22c
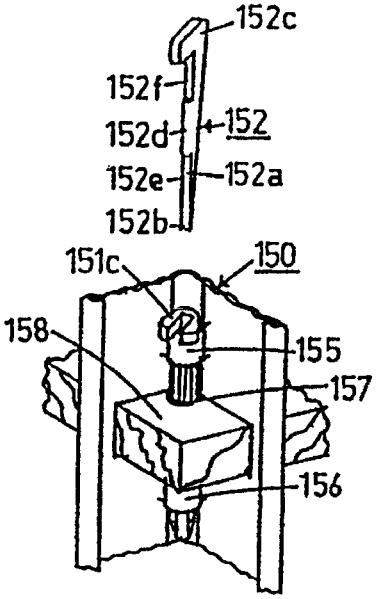
Fig. 22b
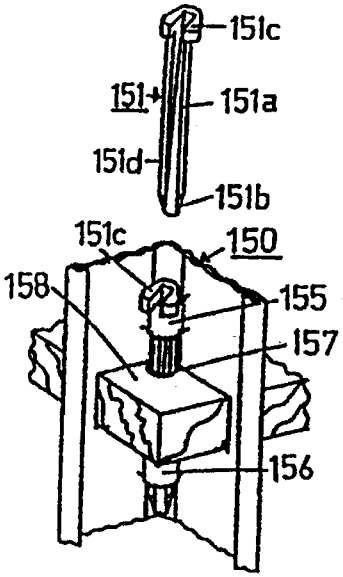
Fig. 22a

SHELVING ASSEMBLIES

RELATED APPLICATION

The present application is a continuation-in-part of my U.S. appplication Ser. No. 08/212,198 filed Mar. 11, 1994.

FIELD AND BACKGROUND OF THE INVENTION

The present invention relates to shelving assemblies, such as may be used in stands of various types, wall-mounted shelves, and the like.

A large number of different types of shelving assemblies have been constructed and are now in use. However, there is a continuous need for shelving assemblies that may be constructed of fewer and simpler parts producible in volume and at low cost, that can be more conveniently assembled according to a wide variety of possible designs, and/or that, when assembled, produce a more sturdy construction.

BRIEF SUMMARY OF THE INVENTION

According to the present invention, there is provided a novel shelving assembly comprising a plurality of posts each including at least two longitudinally-extending sections joined together at an angle to each other along a juncture section. Each of the posts is formed with at least one transverse slot extending through the juncture section and partly through the two longitudinally-extending sections, and is further formed on a face of the juncture section with a pair of coaxial eyelets on opposite sides of the slot. The shelving assembly further includes a panel having an edge received within the slots of the plurality of posts, and a pin passing through each pair of eyelets and through the panel for securing the panel to the posts.

As will be more particularly described below, shelving assemblies constructed in accordance with the foregoing features may be produced with a few relatively simple parts that can be manufactured in volume and at low cost, that can be assembled according to a wide variety of different types of shelving assemblies and stands, and that produce sturdy constructions when assembled.

Further features and advantages of the invention will be apparent from the description below.

BRIEF DESCRIPTION OF THE DRAWINGS

The invention is herein described, by way of example only, with reference to the accompanying drawings, wherein:

FIG. 21 is an exploded view illustrating another manner of producing the eyelets in the previously described shelving assemblies;

FIG. 21*a* illustrates the eyelet construction of FIG. 21 in assembled form;

FIGS. 22*a*–22*c* illustrate three stages in the assembling of a shelving assembly including a modification in the construction of the pin;

DESCRIPTION OF PREFERRED EMBODIMENTS

Figure 1:
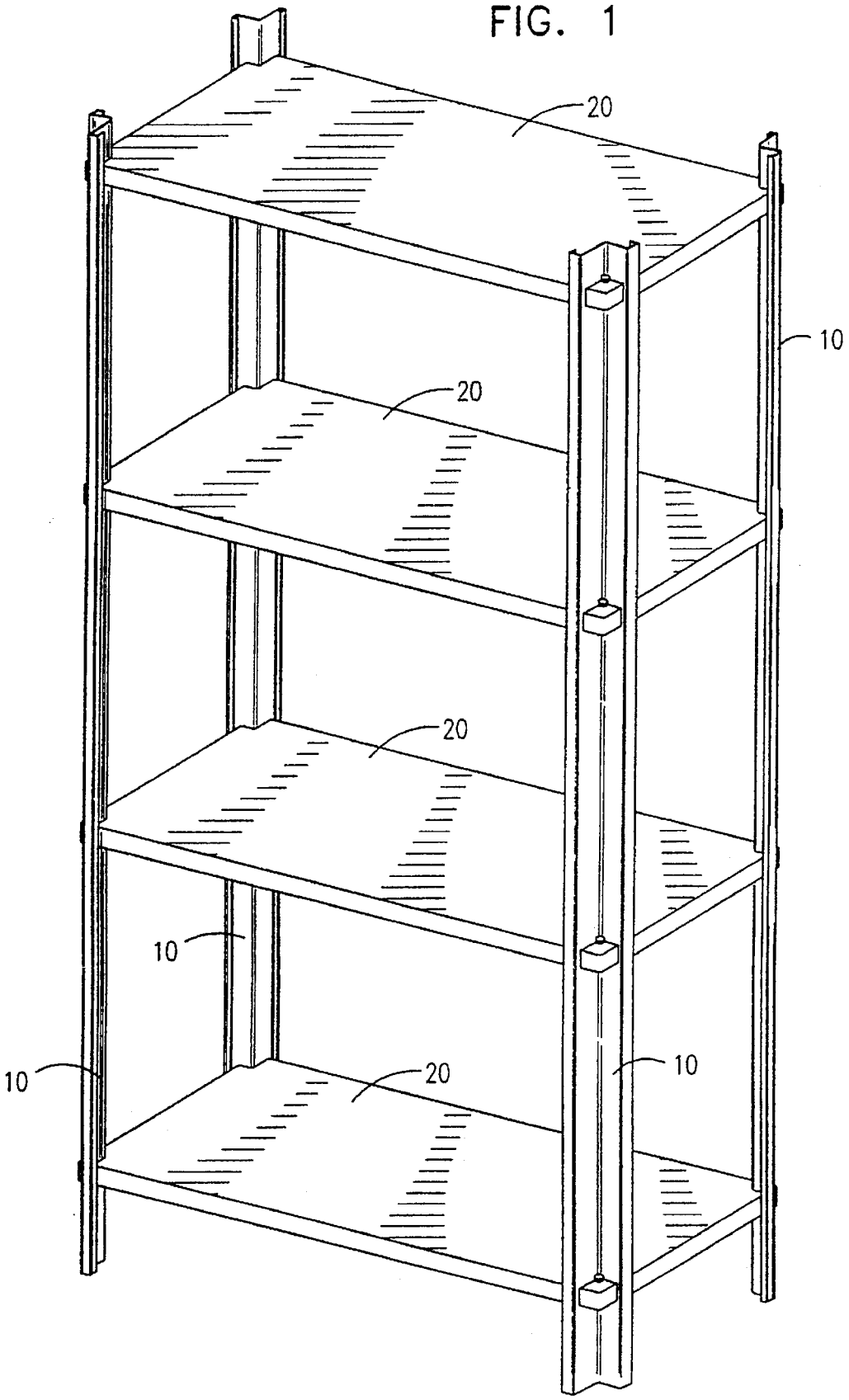
FIG. 1 illustrates one form of shelving assembly as embodied in a stand constructed in accordance with the present invention.

The shelving assembly illustrated in FIG. 1 is a four-shelf stand which may be used as a bookstand, display stand, multi-shelf table, or the like. It includes four vertically-extending posts 10 securing together four horizontally-extending panels 20 in vertically spaced relation.

Figure 2:
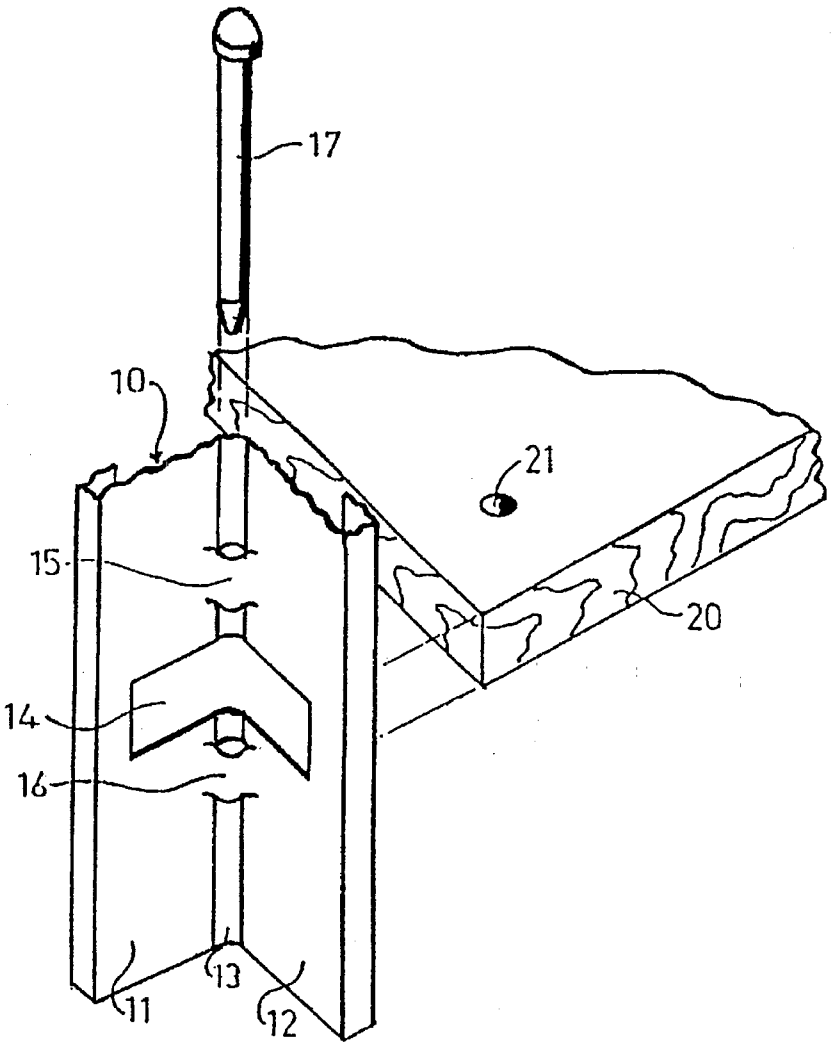
FIGS. 2 and 3 are fragmentary views more particularly illustrating the construction and manner of assembling the stand of FIG. 1.
Figure 3:
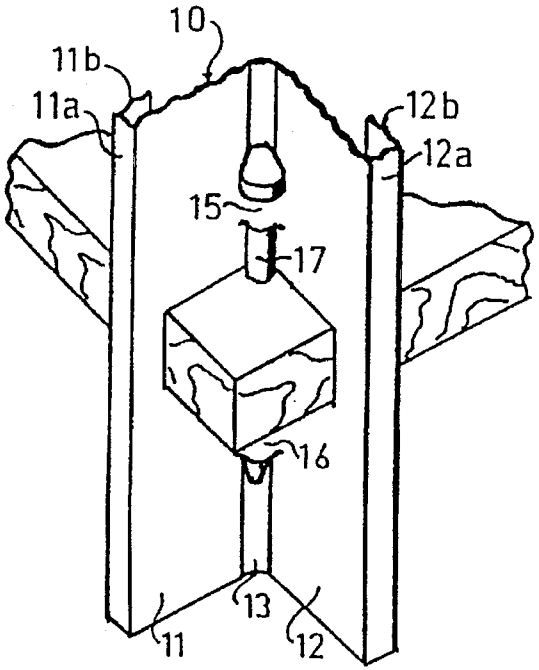
Figure 4:
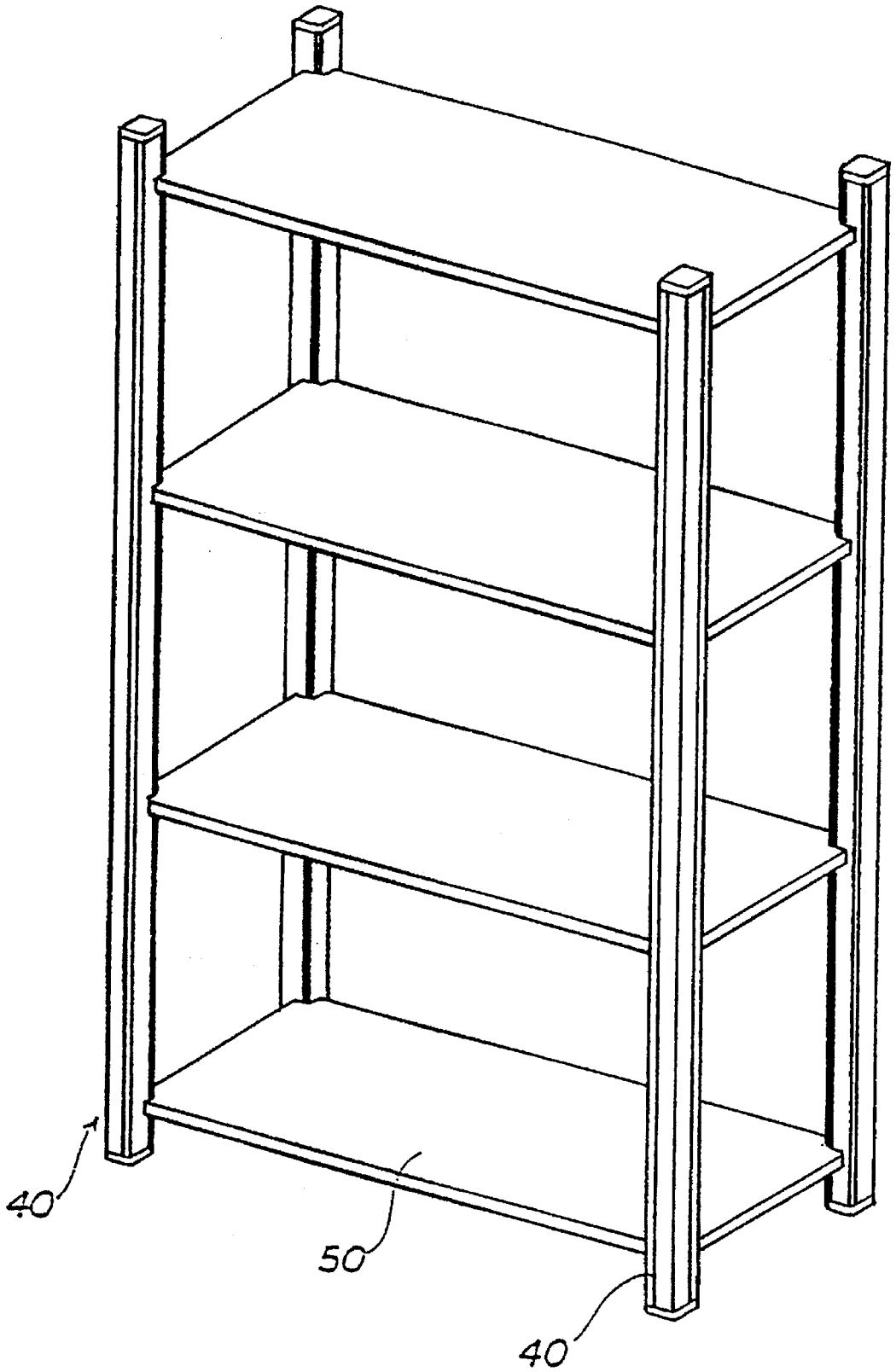
FIG. 4 is a three-dimensional view illustrating another stand constructed in accordance with the present invention.
Figure 5:
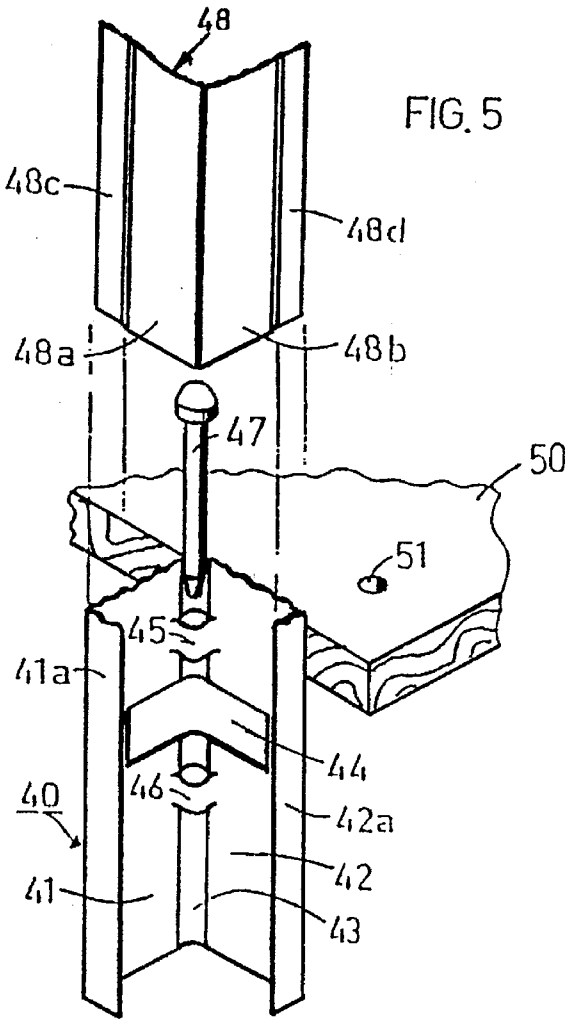
FIGS. 5, 6 and 7 are fragmentary views illustrating the manner of constructing and assembling the stand of FIG. 4.
Figure 6:
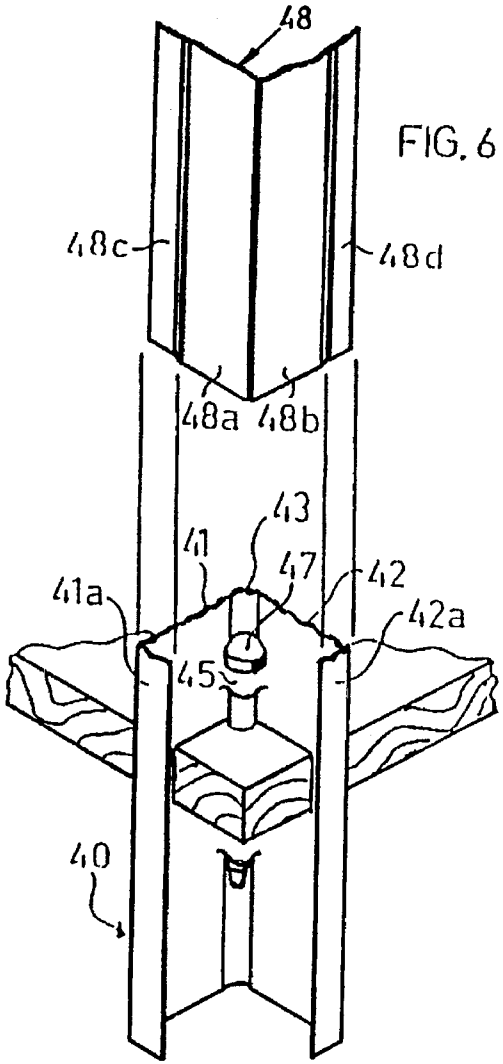
Figure 7:
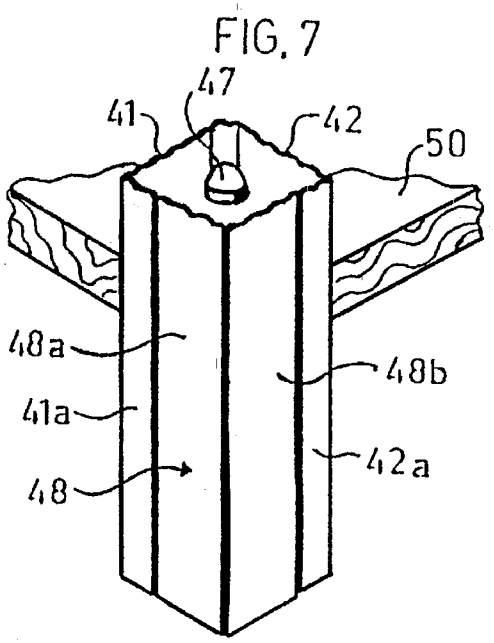

As shown particularly in FIGS. 2 and 3, each of the posts 10 is in the form of a profile member of L-configuration, including two longitudinally-extending sections 11, 12 joined together at a right angle along a juncture section 13. The outer edges of the longitudinally-extending sections 11, 12 are each formed with a first right angle bend 11*a*, 12*a*, and with a second right angle bend 11*b*, 12*b*, respectively, to mechanically strengthen the outer edges of those sections and also to avoid exposing sharp edges.

Each of the posts 10 is further formed with a slot 14 extending transversely through the juncture section 13 and also partly through sections 11 and 12 so that slot 14 is also of L-configuration. A slot 14 is formed in each of the posts 10 for each of the horizontal panels 20, and is of a height substantially equal to the thickness of the panel so that a corner of the panel may be passed through the respective slot 14 as shown particularly in FIG. 3. Each post 10 is further formed with a pair of coaxial eyelets 15, 16, on the opposite sides of each slot 14 for receiving a fastener pin 17.

The four corners of each horizontal panel 20 are formed with holes 21 located to receive the fastener pin 17 when the panel is inserted into slot 14, and the fastener pin is passed through the eyelets 15, 16 in the post.

It will thus be seen that the stand illustrated in FIG. 1 may be easily assembled by merely inserting the corner of each horizontal panel 20 through slot 14 in the four corner posts 10, and then forcing pin 17 through the two eyelets 15, 16 of the post and through hole 21 in the corner of the panel.

The posts 10 may be made of metal or suitable strong plastic material by extruding, slotting at the appropriate intervals with slot 14, and then cutting to the appropriate lengths for the particular application. The horizontal panels 20 may be made of wood or suitable plastic material. Pins 17 may be of metal or suitable plastic material.

The stand illustrated in FIGS. 4–7 also includes four vertically-extending posts 40 securing together four horizontally-extending panels 50 in vertically-spaced relation. As in the construction of FIGS. 1–3, each of the vertical posts 40 is also formed of an L-shaped profile member including two longitudinally-extending sections 41, 42, joined by a juncture section 43, with a transverse slot 44 formed through the juncture section for receiving a corner of the respective horizontal panel 50. Eyelets 45, 46 formed on the opposite sides of each slot 44 receives fastener pins 47 passing through the eyelets and a hole 51 formed in the corners of the respective horizontal panel 50.

In the construction illustrated in FIGS. 4–7, however, the L-shaped profile member is closed by a cover strip 48 in the form of a second profile member also having two perpendicular sections 48*a*, 48*b*, to define a post of a hollow square cross-section. For purposes of receiving the cover strip 48, the two sections 41, 42 are formed with right angle outer extensions 41*a*, 42*a*, and the cover strip 48 is also formed with two outer extensions 48*c*, 48*d* adapted to be slid along the inner surfaces of extensions 41*a*, 42 when the cover strip is end-applied over profile member 40.

It will thus be seen that the stand illustrated in FIGS. 4–7 may be assembled in the same manner as described above with respect to FIGS. 1–3 while the cover strip 48 is not in place, and as soon as the stand has been so assembled, cover strip 48 may then be end-applied between extensions 41*a*, 42*a* of each profile member 40.

Figure 9:
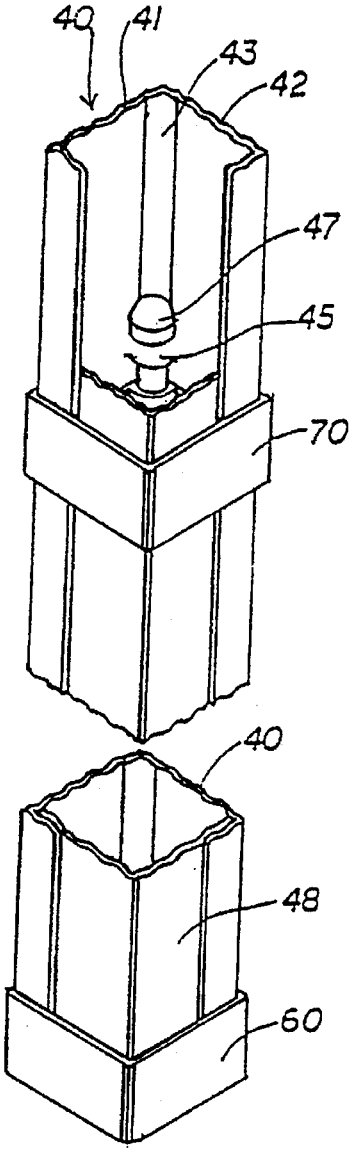
FIG. 9 illustrates the elements of FIG. 8 in assembled condition.
Figure 8:
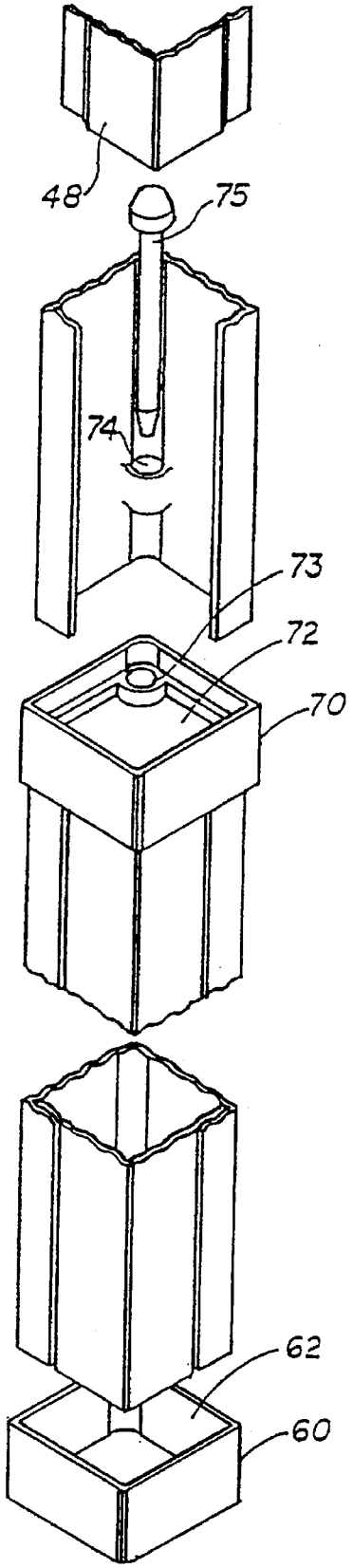
FIG. 8 is an exploded three-dimensional view illustrating how the height of a stand constructed as in FIG. 4 may be increased by stacking the vertically-extending posts of the stand.

FIGS. 8 and 9 illustrate a construction similar to that described above with respect to FIGS. 4–7, except that the construction in FIGS. 8 and 9 further includes caps 60 covering the opposite ends of each vertical post, and also stacking connectors 70 to permit the height of the stand to be increased by vertically stacking one stand on top of another.

The caps 60 applied to both ends of each vertical post are of the same configuration as the posts including their cover strips. Each cap 60 is formed with a cavity 62 having inner dimensions which conform to the outer dimensions of the respective post including its cover strip such that the post and cover strip can be snugly fit into the cavity of the cap. The cap thus closes-off the end of the hollow post, and also it reinforces the hollow post.

A stacking connector 70 is provided for each vertical post when one is to be stacked on top of another in order to increase the height of the stand. Thus, each stacking connector 70 includes a cavity 72 on its opposite faces, the lower one for receiving the underlying vertical post, and the upper one for receiving the overlying vertical post to be stacked over the underlying one. Stacking connector 10 further includes an eyelet 73 alignable with an eyelet 74 at the respective ends of the two vertical posts, for receiving a fastener pin 75 to thereby secure the two vertical posts together with the stacking connector in between.

The construction illustrated in FIGS. 8 and 9 is otherwise the same as described above with respect to FIGS. 4–7, and therefore the same reference numerals have been used for corresponding parts.

Figure 10:
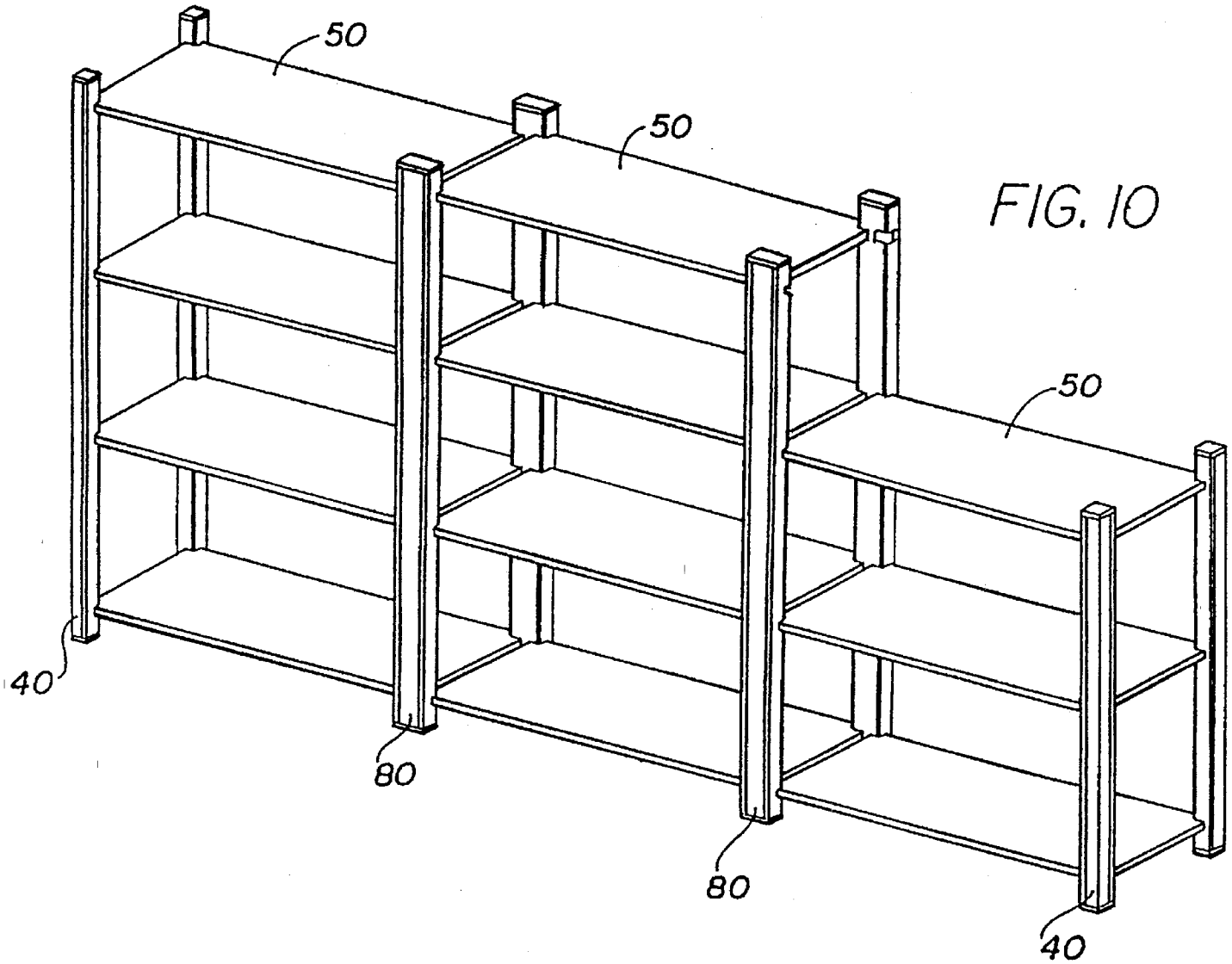
FIG. 10 is a three dimensional view illustrating another stand constructed in accordance with the present invention.

FIG. 10 illustrates a stand constructed of a plurality of vertical columns of panels or shelves 50. Such a stand includes a plurality of vertical posts 40 of the same construction as described above with respect to FIGS. 4–7 at the opposite ends of the complete stand, and other vertical posts 80 of a modified construction at intermediate locations of the stand. The modified vertical posts 80 are basically the same construction as posts 40, except that posts 80 are adapted to secure a horizontal panel 50 on each of its two opposite sides, rather than on only one side as in the case of the vertical posts 40.

Figure 11:
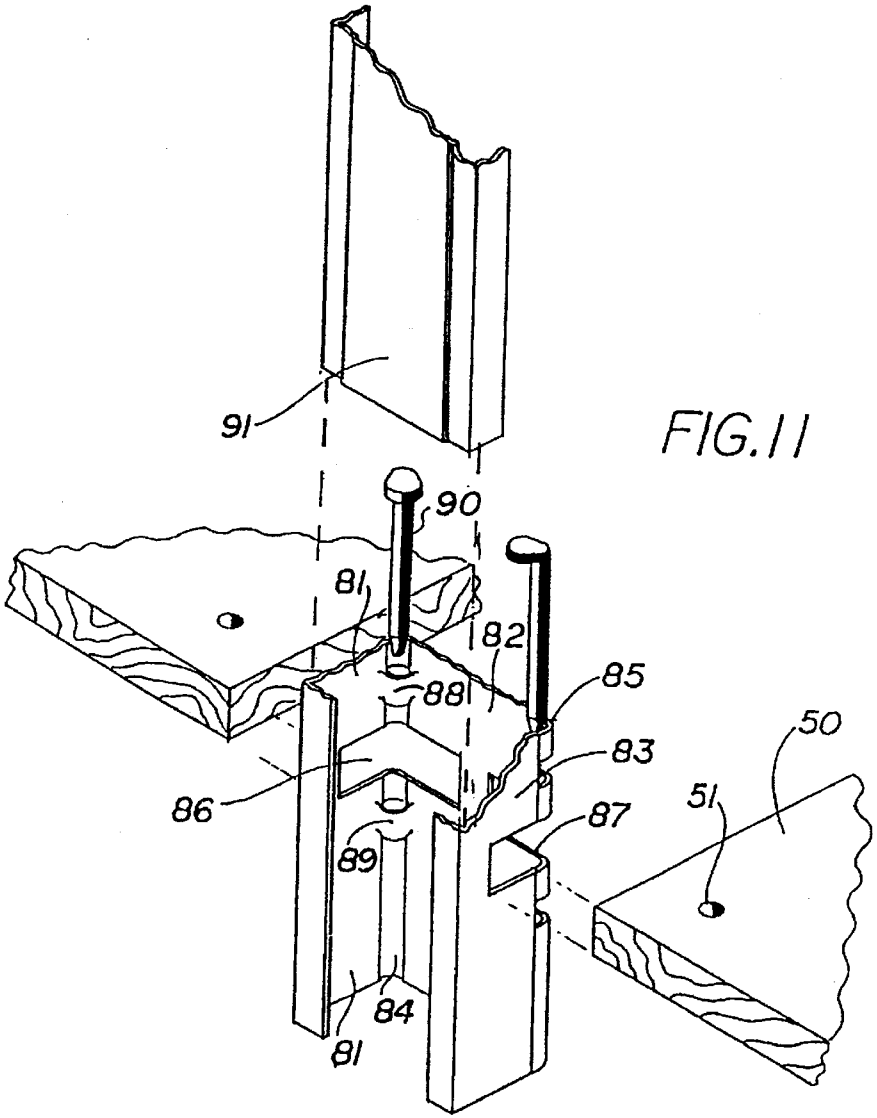
FIGS. 11 and 12 are fragmentary views more particularly illustrating the construction and manner of assembling the stand of FIG. 10.
Figure 12:
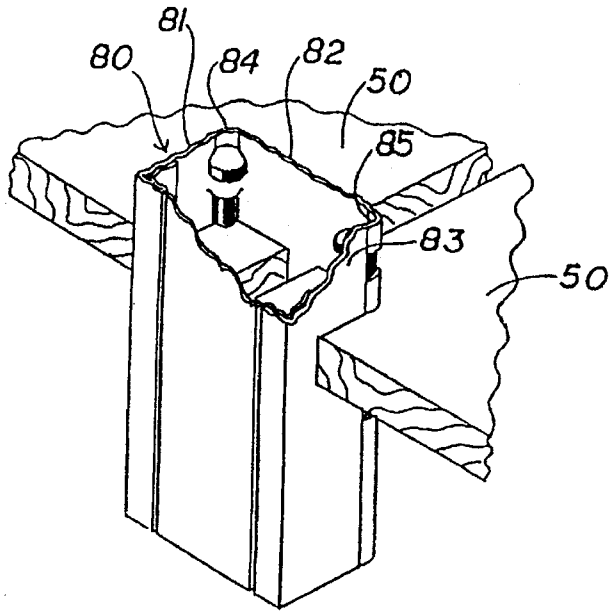

The construction of vertical posts 80 is more particularly illustrated in FIGS. 11 and 12. Each vertical posts 80 is of a U-configuration, being formed with three longitudinally-extending sections 81, 82, 83, joined by two juncture sections 84 and 85, respectively. Each juncture section 84, 85, is formed with a transverse slot 86, 87 for receiving a corner of the respective horizontal panel 50. The two slots 86, 87 are horizontally aligned where it is desired to have the two horizontal panel 50 also in horizontal alignment, as shown in FIGS. 10–12.

Each of the juncture sections 84, 85, is formed with a pair of eyelets 88, 89 on opposite sides of its respective slot 86, 87, for receiving a fastener pin 90 to be passed through the eyelets and also through the opening 51 formed in the corner of the respective horizontal panel 50. Each U-shaped profile including legs 81, 82, 83, is closed by a cover 91.

It will thus be seen that by using the single-sided profile members 40, and the double-sided profile members 80, one may easily assemble a stand of any desired number of vertical columns.

Figure 13:
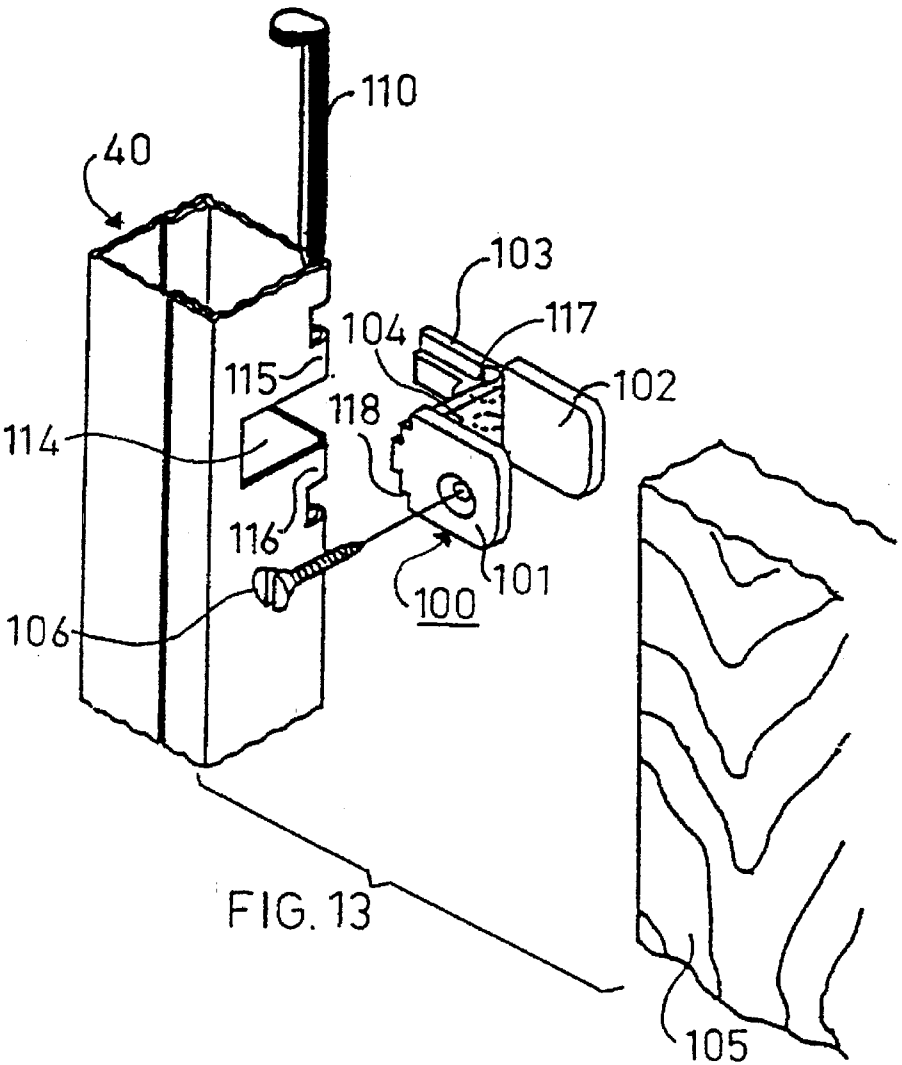
FIG. 13 is an exploded view illustrating the manner of attaching a vertical panel to the stand of any of the previously described figures.
Figure 14:
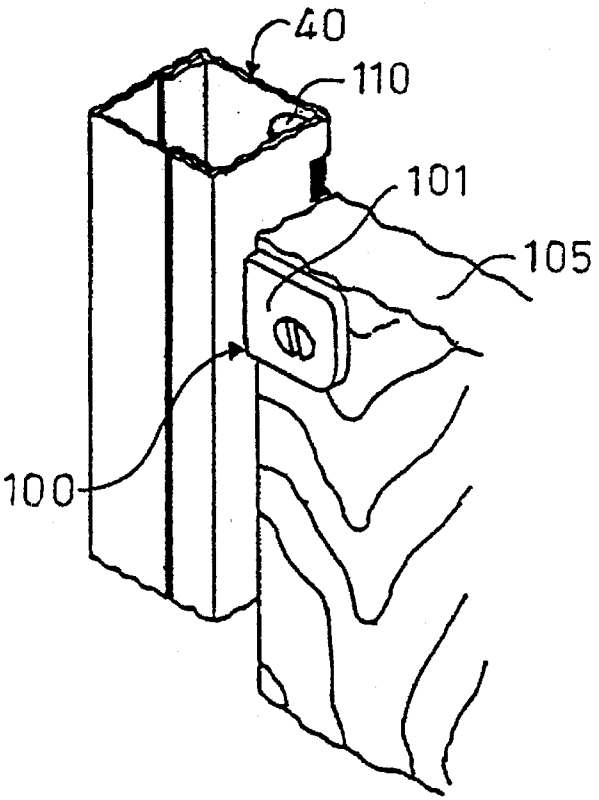
FIG. 14 illustrates the elements of FIG. 13 in assembled condition.

FIG. 13 and 14 illustrate the manner in which vertical panels may also be attached to the stand, e.g., to provide a back panel for the stand.

The vertical panels are secured to the vertical posts 40 by means of brackets, generally designated 100. Each bracket includes two spaced parallel legs 101, 102 projecting from one side, and a third leg 103 projecting from the opposite side, all interconnected by a web section 104. Legs 101 and 102 are spaced apart a distance equal to the thickness of the vertical panel 105 to be secured. The upper edge at one side of vertical panel 105 is received between the two legs 101, 102 and is secured thereto by a threaded fastener 106.

Bracket 100 is in turn secured to the vertical post 40 by a pin 110 in a similar manner as the horizontal panels are secured to the vertical posts as described earlier. One of the transverse slots 114 formed in the vertical posts may be used for this purpose. Thus, leg 103 of bracket 100 is passed through slot 114, and is secured within the vertical post 40 by pin 110 passing through eyelets 115, 116 on the opposite sides of slot 114, and through an opening 117 formed in bracket leg 103. The junctures of the two legs 101, 102 with the interconnecting web section 104 may be stepped, as shown at 118, to receive the edges of the slot 114.

It will be appreciated that the upper ends of both sides of the vertical panel 105 are secured to their respective vertical posts 40 in the above manner by the use of the brackets 100.

Each pre-formed hole in the edge of the panel used in all the previously-described embodiments to attach the panel to the vertical posts (e.g., hole 21 in panel 20, FIG. 2 or hole 51 in panel 50 in FIG. 11), as well as in the further embodiments to be described below, preferably has an axis which is slightly eccentric with respect to the axis of the pair of eyelets as shown for example in FIG. 16; the eccentricity is in the direction such that forcing the pin through the pre-formed hole and eyelets cams the panel firmly into the corner slot of the post. This rigidifies the overall structure.

FIGS. 15*a*–15*d* illustrate a modification that may be made in the construction of the transverse slots in the previously-described embodiments, as well as in those to be described below. The example illustrated in FIGS. 15*a*–15*d* is similar to that of FIGS. 5–7, namely including a post 120 having two longitudinally-extending sections 121, 122 joined together at an angle to each other along a juncture section 123, with a transverse slot 124 extending through the juncture section 123 and partly through sections 121, 122, and a pair of coaxial eyelets 125, 126 on opposite sides of the slot 124. In the construction illustrated in FIGS. 15*a*–15*d*, however, the transverse slot 124 is bordered by a right angle flange 124*a*–124*f* along each edge of the slot for engaging and securely holding the panel 127 when received within the transverse slot 124 and secured therein by pin 128 passing through the pre-formed hole 129 in panel 127 and the coaxial eyelets 125, 126.

Figure 16:
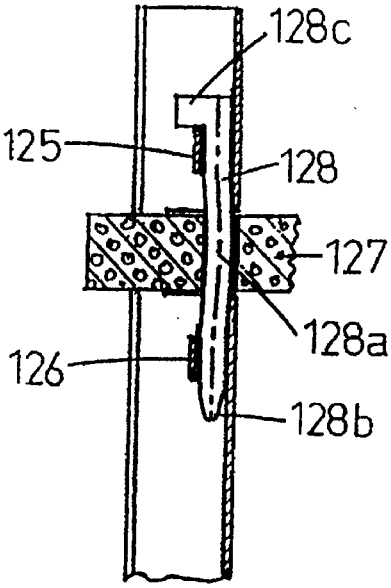
FIG. 16 is a side elevational view, partly in section, illustrating the assembled condition of the shelving.

As shown in FIG. 16, pin 128 is of hard plastic material integrally formed with a shank 128*a*, a tapered tip 128*b* at one end, and an enlarged head 128*c* at the opposite end. As described earlier, the pre-formed hole 129 in the panel 127 is slightly eccentric with respect to the two eyelets 125, 126, such that forcing the pin through the hole and the eyelets firmly press the board into the transverse slot 124, at the same time slightly distorting the pin as shown in FIG. 16, to thereby rigidify the assembly. The head 128*c* of the pin is enlarged on one side to provide a relatively large finger-engaging surface for forcing the pin into the eyelets, but on the other side it is substantially flush with the outer surface of the shank 128*a* such that this side of the head, together with the corresponding side of the shank, are brought into firm contact with the inner surface of the post when the pin is forced in place, thereby further rigidifying the assembly.

Figure 15A:
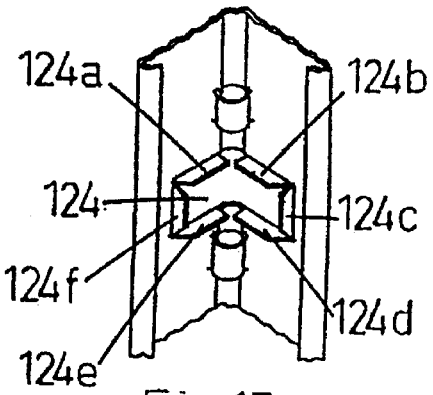
FIGS. 15*a*–15*c* are exploded views illustrating three stages in assembling a further type of shelving assembly constructed in accordance with the present invention.
Figure 15B:
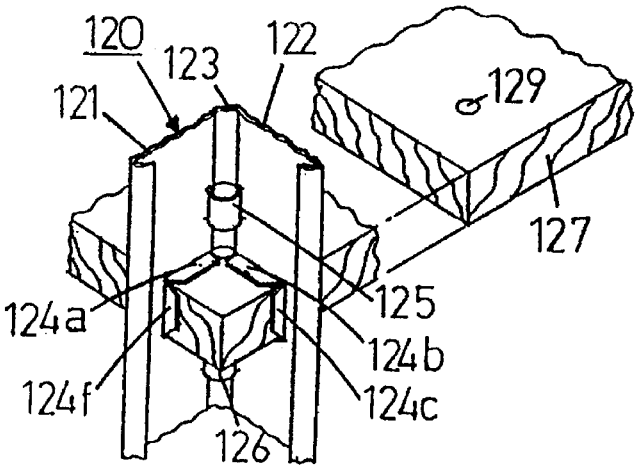
Figure 15D:
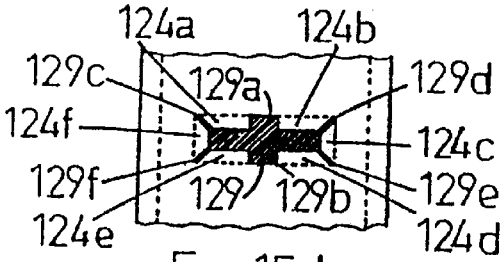
FIG. 15*d* illustrates the manner of making the transverse slot in the shelving assembly of FIGS. 15*a*–15*c;*
Figure 15C:
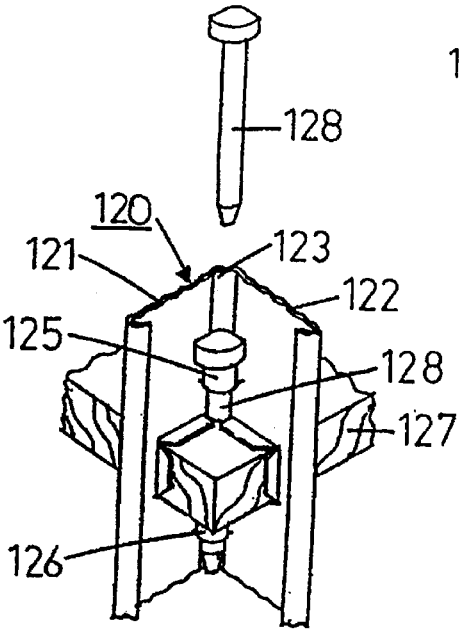

FIG. 15*d* illustrates the manner of making the flanges 124*a*–124*f* bordering the transverse slot 124. This is done by forming each of the transverse slots 124 of a cutout according to the configuration illustrated by the shaded lines 129 in FIG. 16. Thus, cutout 129 is of smaller dimensions than the transverse slot 124, but is formed with perpendicular wide slits 129*a*, 129*b* centrally of its opposite sides, and angled narrow slits 129*c*–129*f* at its outer corners so as to permit the flanges 124*a*–124*f* to be bent inwardly, along their respective fold lines 124*a*'–124*f*', as shown in FIGS. 15*a*–15*d*. Such a slot construction provides larger-area surfaces engageable with the panel 127 to thereby further rigidify the assembly.

Figure 17A:
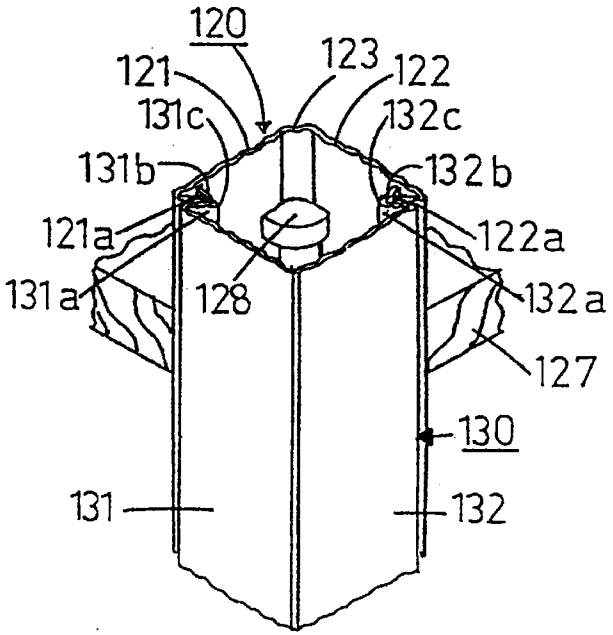
FIG. 17*a* is an assembled view, illustrating a further form of shelving assembly constructed in accordance with the present invention.
Figure 17:
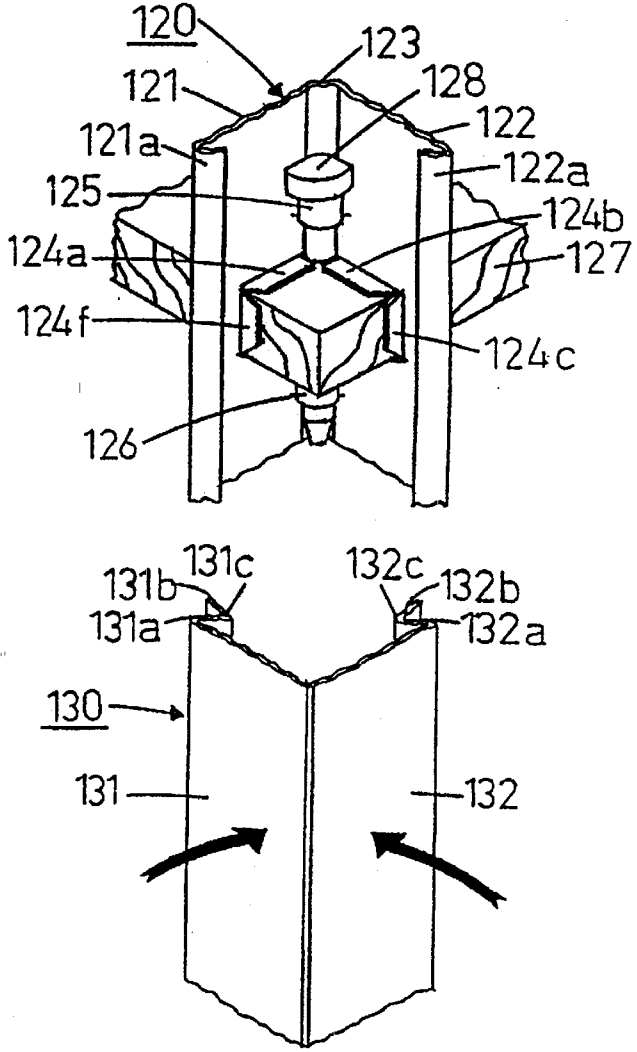
FIG. 17 is an exploded view.

The shelving assembly illustrated in FIGS. 17 and 17*a* is similar to that of FIGS. 15*a*–15*d*, except that it includes a cover profile member 130 which may be side-applied to the mounting profile member 120, rather than end-applied as described above with respect to FIGS. 5–7. Thus, the cover member 130 also includes short inwardly-directed extensions 131*a*, 131*b*, at the outer ends of the two longitudinal sections 131, 132, respectively, corresponding to the inwardly-directed extensions 121*a*, 122*a*, of sections 121, 122 of mounting member 120. The cover member 130, however, includes short outwardly-direct extensions 131*b*, 132*b*, at the outer edge of its extensions 131*a*, 132*a*. Both pairs of extensions are dimensioned to permit the cover member 130 to be side-applied to the mounting member 120, and the extensions 121*a*, 122*a* of mounting member 120 to be snapped into the junctures 131*c*, 132*c*, of cover member 130, as shown in FIG. 17*a*.

Figures 18, 19A, 19B, 19C, 20, 20A:
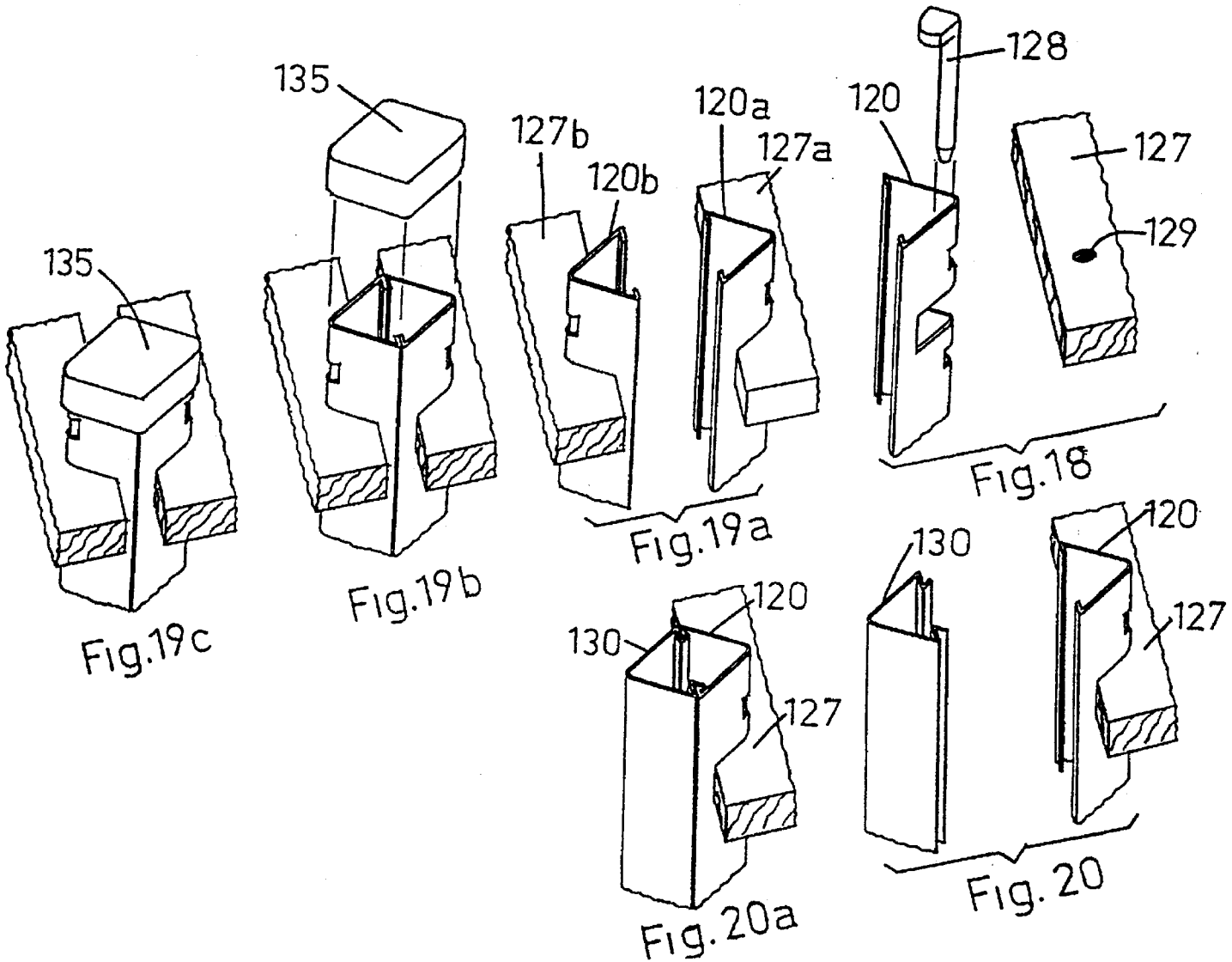
FIG. 18 is an exploded view illustrating a still further form of shelving assembly in accordance with the present invention.
FIGS. 19*a*–19*c* illustrate three stages in assembling a two-column assembly each including the shelving assembly of FIG. 18.
FIG. 20 is an exploded view illustrating a still further form of shelving assembly in accordance with the present invention.
FIG. 20*a* illustrates the shelving assembly of FIG. 20 in assembled form.

FIG. 18 illustrates a variation wherein the panel 127 is attached to the mounting member 120 not at a corner of the panel, but rather at an intermediate edge in the panel. For this purpose, panel 127 is pre-formed with hole 129' at the appropriate location with respect to the edge of the panel.

FIGS. 19*a*–19*c* illustrate how the shelf-assembly of FIG. 18 may be used for assembling a two-column shelving construction. Thus, each column includes a profile member 120*a*, 120*b*, similar to profile member 120 in FIG. 18, and each adapted to receive an edge of a panel member 127*a*, 127*b*, fixed thereto by a pin 128 as described above with respect to FIG. 18. Both profile members 120*a*, 120*b*, are thus used as mounting members and may be secured together by caps 135 at one or both of their ends.

FIGS. 20 and 20*a* illustrate a shelving assembly similar to that of FIGS. 17 and 17*a*, except that the panel 127 is mounted at an intermediate edge as shown in FIG. 18, rather than at the corner. The shelving assembly illustrated in FIGS. 20, 20*a* is otherwise the same as described above with respect to FIGS. 17 and 17*a*, and therefore its parts have been correspondingly numbered.

FIGS. 21 and 21*a* illustrate a modification in the construction of the eyelets that may be used in any of the embodiments described earlier. Thus, instead of merely striking the eyelets from the juncture section, shown at 143, of the profile member 140, the eyelets 145, 146 may be produced as separate members and received within further slots 147, 148, formed substantially only in the juncture section 143 on opposite sides of the transverse slot 144 receiving the panel.

Thus, each of the eyelet members 145, 146 includes a circular loop 145*a*, 146*a*, of a height to be passed through the further slots 147, 148, respectively. Members 145, 146 further include a mounting strip 145*b*, 146*b* of greater height than slots 147, 148 and having the same curved configuration as the juncture section 143 of profile member 140. When a pin is passed through the aligned loops 145*a*, 146*a* of the eyelet members 145, 146, the mounting strips 145*b*, 146*b* are firmly pressed against the outer surfaces of the two longitudinally-extending sections 141, 142 of profile member 140, to securely attach the two eyelet members, and the panel member held thereby, to the profile member 140.

FIGS. 22*a*–22*c* illustrate a another construction that may be used for the fastening pins in any of the previously-described embodiments. In FIGS. 22*a*–22*c*, the fastening pin, generally designated 150, is of a two-part construction including a first part 151 and a second part 152.

The first part 151 includes a shank 151*a* having a tapered tip 151*b* at one end, and an enlarged head 151*c* at the opposite end. A slot 151*d* is formed longitudinally along the complete length of the shank from its tapered tip 151*b* to its enlarged head 151*c*.

The second part 152 of pin 150 similarly includes a shank 152*a* formed with a tapered tip 152*b* at one end, and with an enlarged head 152*c* at the opposite end. Part 152, however, is of a thickness to be received within slot 151*d* and to be slidable along its length. The intermediate portion 152*d* of shank 152*a* is of round, conical configuration.

Slot 151*d* in part 151, and the shank 152*a* of part 152, are of tapered thickness such that part 151 may be freely inserted through the aligned eyelets 155, 156 and the pre-formed hole 157 in panel 158 (which hole is of larger diameter than part 151); and then part 152 may be inserted via slot 151*d* in part 151. By forcing part 152 further along the slot in part 151, the outer surface of the conical portion 152*d* of part 152 engages the edge of the preformed hole 157 in panel 158 and firmly cams the panel into the slot (e.g. 144 FIG. 21) of the profile member.

The outer surface of part 152 is inwardly stepped, as shown at 152*e* and 152*f* in FIG. 22*b*, on opposite sides of the conical wedging portion 152*d*. This prevents the stepped portions 152*e* and 152*f* from wedging against the inner surface of the eyelet, and thereby better assures the wedging action will occur between the conical portion 152*d* of the shank and the pre-formed hole in the panel.

In assembling the shelving, all the shelves are first assembled to the posts by passing the first parts 151 of all the pins through their respective eyelets and pre-formed openings in the shelves; this may be done quickly and conveniently since the first pin parts 151 freely pass through their respective eyelets and pre-formed holes. After the shelving is thus initially assembled, the second pin parts 152 are then inserted and forced through the respective eyelets and pre-formed holes to firmly fix the shelves to the posts and thereby to rigidify the assembly. Thus, if a tool, such as a hammer, is used for driving the second pin parts, this may be done at one time for all the pins.

The shelving is disassembled in the same manner, i.e., by first removing the second pin parts 152 of all the pins in the assembly, using a tool if necessary, and then removing all the first pin parts 151 to disassemble the shelves from the posts.

Figure 23A:
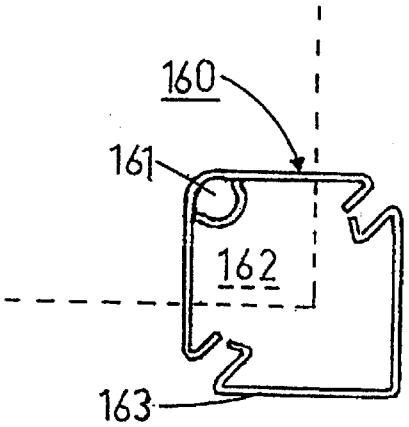
FIGS. 23*a*–23*d* illustrate other profile shapes which may be used for the posts.
Figure 23B:
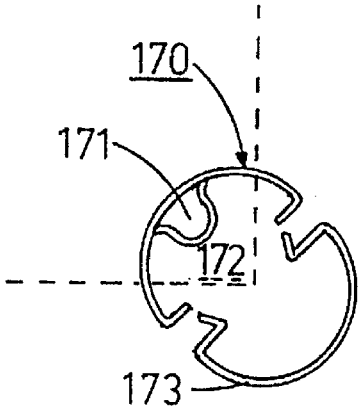
Figure 23C:
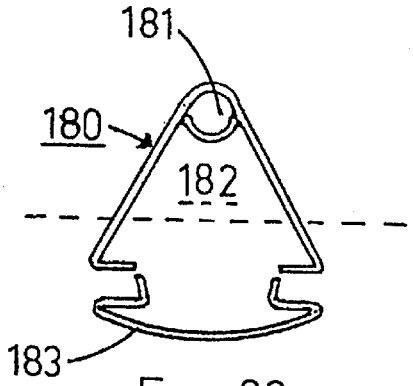
Figure 23D:
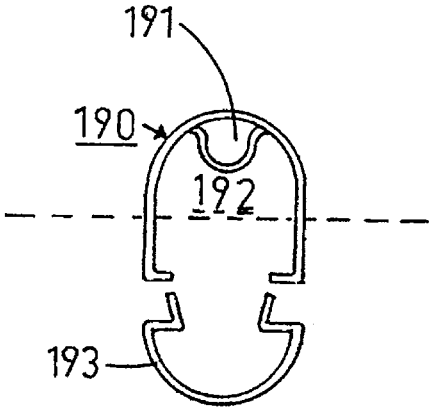

FIGS. 23*a*–23*d* illustrate other profile shapes which may be used for the posts. Thus, FIG. 23*a* illustrates the profile member 160 of the L-shape described above, e.g., with respects to FIGS. 17 and 17*a*, including the eyelets 161 at the juncture of the two post legs for receiving a corner of the panel 162 and also for receiving an L-shaped cover 163; FIG. 23*b* illustrates the profile member 170 of semi-circular shape with the eyelets 171 at the center for receiving a corner of the panel 172 and also for receiving a semi-circular cover 173; FIG. 23*c* illustrates the profile member 180 including two legs at an acute angle with the eyelets 181 at the juncture between the two legs, for receiving a mid-portion of the edge of the panel 182, the profile member being closed by an arcuate cover 183; and FIG. 23*d* illustrates the profile member 190 of semi-circular shape with the eyelets 191 at the center for receiving a mid-portion of the edge of the panel 192, and a semi-circular cover 193.

Figure 24A:
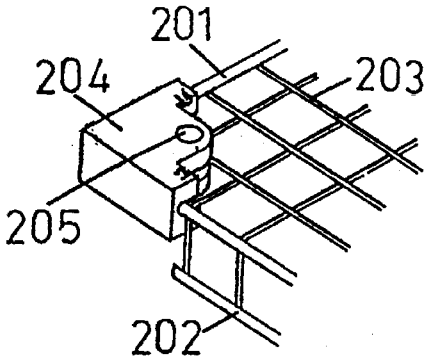
FIG. 24*a* is an assembled view, illustrating a metal wire grid construction that may be used for the panels.
Figure 24:
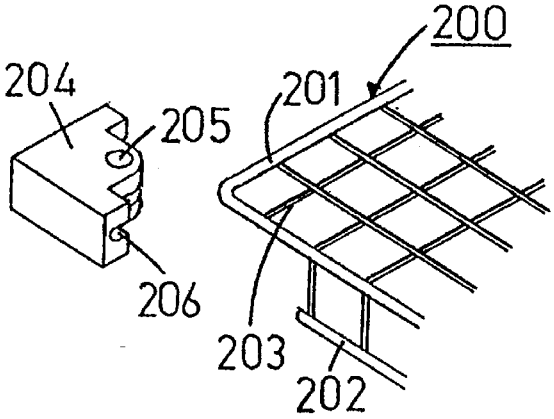
FIG. 24 is an exploded view.
Figure 25A:
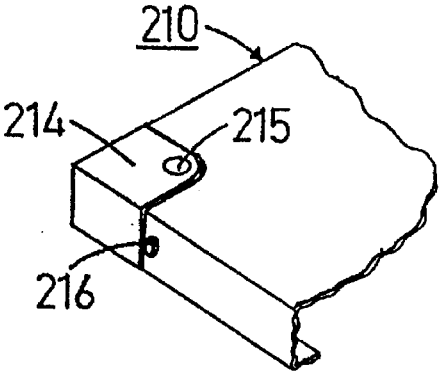
FIG. 25*a* is an assembled view, illustrating a sheet metal construction that may be use for the panels.
Figure 25:
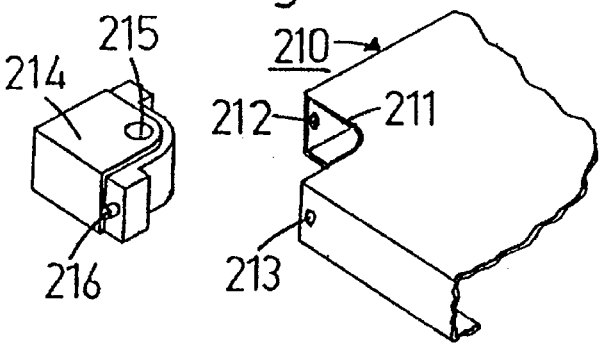
FIG. 25 is an exploded view.
Figure 26:
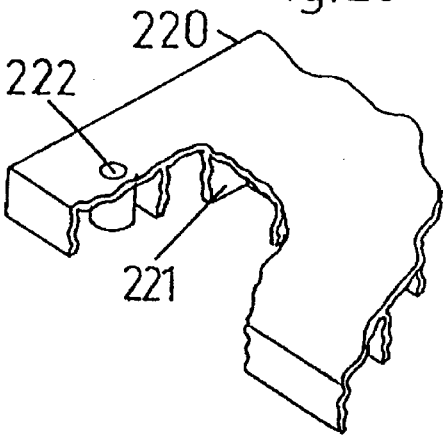
FIG. 26 is a fragmentary view illustrating a plastic construction that may be used for the panels.

FIGS. 24–26 illustrate various constructions that may be used for the shelf panel. Thus, FIG. 24 illustrates a shelf panel 200 constructed of an open metal wire grid including upper and lower wire frames 201–202 of relatively large-diameter wire joined to smaller-diameter wires 203. In this construction, a corner member 204 (e.g., of plastic or metal) pre-formed with the assembling hole 205, is attached to the frame member 201, e.g., by inserting the upper frame 201 into a groove 206 in the corner member and crimping the corner member to the frame, as shown in FIG. 24*a*.

FIG. 25 illustrates a shelf panel 210 formed with a corner cutout 211 and with holes 212, 213 in the panel wall adjacent the cutout, for receiving a corner member 214. The corner member is pre-formed with the assembling hole 215 and is attachable to the sheet metal panel 210 by pins 216 received within holes 212, 213, as shown in FIG. 25.

FIG. 26 illustrates a panel 220 of moulded plastic material formed with strengthening ribs 221 and also pre-formed with holes 222 at its corners, or at a mid-portion thereof, for use in assembling the panel to the posts in any of the manners described above.

It will be appreciated that the construction of the transverse slot 124 illustrated in FIGS. 15*a*–17*a*, the construction of the eyelets illustrated in FIGS. 21, 21*a*, and the construction of the pin illustrated in FIGS. 22*a*–22*c*, may be used with respect to any of the described embodiments. It will also be appreciated that the various embodiments described are set forth merely for purposes of example, and that many other variations and applications of the invention may be made.

I claim:

1. A shelving assembly, comprising:

a plurality of posts each including at least two longitudinally-extending sections joined together at an angle to each other along a juncture section having inner and outer faces;

each of said posts being formed with at least one transverse slot extending through said juncture section and partly through said two longitudinally-extending sections;

each of said posts being further formed on the inner face of said juncture section with a pair of coaxial eyelets on opposite sides of said slot;

a panel having an edge received within said slot of each of said plurality of posts;

and a pin passing through each pair of said eyelets and through said panel for securing the panel to said posts.

2. The shelving assembly according to claim 1, wherein each edge of the panel received in one of said slots is preformed with a hole having an axis slightly eccentric with respect to the axis of said eyelets in the direction such that forcing the pin through said pre-formed hole and eyelets cams the panel firmly against the inner surface of the post to thereby rigidify the assembly.

3. The shelving assembly according to claim 2, wherein said pin has a shank receivable in said pair of eyelets, and a head which is enlarged on one side with respect to said shank and substantially flush with the shank on the opposite side such that said opposite side of the head and the shank flush therewith are in firm contact with the respective post to further rigidify the assembly.

4. The shelving assembly according to claim 2, wherein said pin is of a two part construction, including:

a first part formed with a shank having a tapered tip at one end and an enlarged head at the other end, said first part being further formed with a slot extending the length of the shank from its tapered tip to its enlarged head;

and a second part also formed with a shank having a tapered tip at one end and an enlarged head at the opposite end, the shank of said second part being slidably received within said slot of the first part and having a mid-portion receivable in said pre-formed hole in the panel.

5. The shelving assembly according to claim 4, wherein said slot in the shank of the first pin part, and the shank of the second pin part received within said slot, are of tapered thickness such that said second pin part produces a wedging action with respect to said first pin part and the pre-formed hole in the panel when the second pin part is moved in the slot of the first pin part.

6. The shelving assembly according to claim 5, wherein said second pin part is inwardly-stepped at opposite sides of said mid-portion thereof received in said preformed hole in the panel, to assure the wedging action will occur between said mid-portion of the shank of the second pin part and the pre-formed hole in the panel.

7. The shelving assembly according to claim 1, wherein each post includes:

a first profile member formed with said two longitudinally-extending sections which sections are perpendicular to each other, and with a short outer extension at the outer edge of each of said longitudinally-extending sections inwardly directed at an acute angle thereto;

and a second profile member formed with two longitudinally-extending sections perpendicular to each other and joined by a juncture section, and with a short outer extension at each outer edge thereof inwardly-directed at an acute angle thereto and engageable with the short outer extensions of the first profile member when the two profile members are assembled together.

8. The shelving assembly according to claim 7, wherein said two profile members are assembled together by a cap applied to at least one of their ends.

9. The shelving assembly according to claim 7, wherein said second profile member is further formed at the outer edge of each of its inwardly-directed extensions with an outwardly-directed extension dimensioned to permit the second profile member to be side-applied to the first profile member with the outer extension of the first profile member snapped into the juncture between the inwardly-directed extension and outwardly-directed extension of the second profile member.

10. The shelving assembly according to claim 7, wherein the second profile member is not slotted and serves as a cover for the first profile member.

11. The shelving assembly according to claim 7, wherein the second profile member is also formed with at least one transverse slot extending through its juncture section and partly through its two longitudinally-extending sections, and with a pair of coaxial eyelets on opposite sides of its slot for receiving the edge of a second panel; said shelving assembly further including a pin for passing through each pair of said latter eyelets and said latter panel when recieved in said slot.

12. The shelving assembly according to claim 7, further including a stacking connector having a socket on one side for insertion over the top of a first post, and a like socket on its opposite side for receiving the bottom of a second post to be stacked thereon.

13. The shelving assembly according to claim 12, wherein each of said stacking connectors, and the respective ends of said first and second posts, are each formed with an internal eyelet for receiving a pin for fastening together the two posts and the stacking connector in between.

14. The shelving assembly according to claim 1, wherein each of said posts includes a profile member having three longitudinally-extending sections joined together in a U-configuration along first and second juncture sections, each post including a first slot through the first juncture section for receiving the edge of a first panel, and a second slot through the second juncture section for receiving the edge of a second panel.

15. The shelving assembly according to claim 1, wherein each transverse slot is bordered by a right angle flange along each edge for engaging and securely holding said panel therein.

16. The shelving assembly according to claim 15, wherein said flanges are produced by forming each of said transverse slots of a cutout of smaller dimensions than the slot but with slits permitting the edges of each cutout to be bent inwardly to produce the transverse slot and the right angle flanges along its edges.

17. The shelving assembly according to claim 1, wherein said eyelets are integrally formed with the respective juncture section of the post.

18. The shelving assembly according to claim 1, wherein said eyelets are formed as separate eyelet members received through further slots formed substantially only in the juncture sections of the posts.

19. The shelving assembly according to claim 18, wherein each of said eyelet members includes a circular loop of a height to be passed through said further slots, and a mounting strip of greater height than said further slots and configured according to the juncture section of the post so as to engage the outer surface of said juncture section when the circular loop is passed through said further slot.

20. The shelving assembly according to claim 1, wherein said pin is of a single part construction and includes a shank having a tapered tip at one end and an enlarged head at the opposite end.

* * * * *